United States Patent [19]

Littmann et al.

[11] 4,202,711

[45] May 13, 1980

[54] PROCESS FOR PRODUCING ORIENTED SILICON IRON FROM STRAND CAST SLABS

[75] Inventors: Martin F. Littmann, Middletown, Ohio; Allan R. Obman, Valencia, Pa.

[73] Assignee: Armco, Incl., Middletown, Ohio

[21] Appl. No.: 952,313

[22] Filed: Oct. 18, 1978

[51] Int. Cl.[2] ..... H01F 1/04

[52] U.S. Cl. ..... 148/111; 148/113

[58] Field of Search ..... 148/111, 113, 112

[56] References Cited

U.S. PATENT DOCUMENTS

| | | | |
|---|---|---|---|
| 2,599,340 | 6/1952 | Littmann | 148/112 |
| 2,867,558 | 1/1959 | May | 148/111 |
| 3,147,158 | 9/1964 | Fiedler | 148/111 |
| 3,671,337 | 6/1972 | Kumai et al. | 148/112 |
| 3,764,406 | 10/1975 | Littmann | 148/112 |
| 3,876,476 | 4/1975 | Matsuoka et al. | 148/112 |
| 4,006,044 | 2/1977 | Oya et al. | 148/31.55 |
| 4,030,950 | 6/1977 | Shilling et al. | 148/111 |
| 4,039,321 | 8/1977 | Matsunaga et al. | 75/60 |
| 4,115,160 | 9/1978 | Benford et al. | 148/111 |
| 4,123,298 | 10/1978 | Kohler et al. | 148/111 |

FOREIGN PATENT DOCUMENTS

| | | |
|---|---|---|
| 826152 | 8/1975 | Belgium . |
| 857596 | 8/1976 | Belgium . |
| 09122 | of 1970 | France . |
| 49-24767 | of 1974 | Japan . |

*Primary Examiner*—L. Dewayne Rutledge
*Assistant Examiner*—John P. Sheehan
*Attorney, Agent, or Firm*—Frost & Jacobs

[57] ABSTRACT

A process for producing grain oriented silicon iron from strand cast slabs having uniformly high permeability and low core loss, comprising the steps of melting and refining a ferrous charge to obtain a melt containing critical ranges of carbon, manganese, sulfur and/or selenium and critically low levels of nitrogen, aluminum, and titanium, casting to a slab thickness of about 125 to about 225 mm, reheating the slabs to about 1330° to about 1400° C., hot rolling, annealing at about 925° to about 1050° C., cold rolling in two stages with an intermediate anneal to final thickness, decarburizing, and subjecting the material to a final anneal in a hydrogen-containing reducing atmosphere to effect secondary recrystallization.

14 Claims, No Drawings

PROCESS FOR PRODUCING ORIENTED SILICON IRON FROM STRAND CAST SLABS

BRIEF SUMMARY OF THE INVENTION

The present invention relates to the production of conventional grain oriented silicon iron having the cube-on-edge texture from strand cast or continuous cast slabs by a method which provides uniformly high permeability (measured at 800 ampere turns per meter) and low core loss (measured in watts per kilogram at 1.5 Tesla and higher).

Strand casting into a continuous slab or casting into individual slabs of a thickness suitable for direct hot rolling (e.g. 125 to 225 mm) is advantageous from the standpoint of processing costs and yield, in comparison to the conventional practice of casting into ingots, rolling the ingots to slabs, heating or reheating the slabs, and hot rolling to band thickness. However, it has not been possible merely to substitute strand cast slabs in place of slabs rolled from ingots in the production of grain oriented silicon iron because of lack of uniformity and general inferiority in magnetic properties of the final product. In present commercial practice, relatively slight inferiority and lack of uniformity in magnetic properties can place the product at a competitive disadvantage. The primary objective of this invention is to provide a method of producing regular grade grain oriented silicon iron from continuously cast slabs with magnetic properties equal or superior to that obtained from ingots.

Among the difficulties encountered in substitution of strand casting in place of conventional casting into ingots in the production of oriented silicon iron are the tendency for the strand cast slabs to exhibit defects which cause blisters or lamination in the rolled product, changes in the form and distribution of grain growth inhibitors, particularly manganese sulfide, which control the development of crystal texture, and the occurrence of excessive grain growth in the slabs during reheating prior to hot rolling which adversely affects the development of crystal texture in the final product.

It is well known that the grain structure of the final product depends upon the formation in the silicon iron of a finely dispersed precipitate which acts as a grain growth inhibitor during processing, and particularly which promotes secondary recystallization during a final high temperature anneal. Manganese sulfide is conventionally used as a grain growth inhibitor, although manganese selenide and aluminum nitride, and combinations thereof, are also used. It is essential that these phases be dissolved in the solidified silicon iron before the slab or ingot is hot rolled into band thickness. During the hot rolling the dissolved grain growth inhibitors are precipitated as fine particles due to the relatively rapid cooling which occurs during hot rolling.

The inhibitor is dissolved by heating to a temperature from about 1350° to about 1400° C. prior to hot rolling, as disclosed in U.S. Pat. No. 2,599,340. This is effective to dissolve conventional amounts of manganese sulfide in slabs rolled from ingots, which is on the order of 0.08% manganese and 0.025% sulfur. If the oxygen content is kept relatively low, somewhat lower slab reheat temperatures may be used.

It has been found to be more difficult to dissolve the manganese sulfides in strand cast slabs than in slabs formed from ingots. Hence lower amounts of manganese sulfide must be present. However, a slab reheat temperature within the range of about 1370° to 1400° C. is needed even with the lower manganese sulfide contents. The reheating of strand cast slabs within this temperature range has caused an unusual problem, namely excessive grain growth which results in incomplete recrystallization during subsequent processing. Although excessive grain growth can be avoided partially by increasing the carbon content to about 0.030% to 0.040% (in comparison to the conventional carbon content of 0.020% to 0.030%), as disclosed in French Pat. No. 70.09122 in the name of Armco Steel Corporation, this higher carbon content alone does not ensure high permeability and low core loss in the final product.

U.S. Pat. Nos. 3,671,337 and 4,006,044 disclose a solution to the problem of excessive grain growth in the slabs by decreasing the slab reheat temperature, decreasing the manganese sulfide content and supplementing the inhibitor with aluminum nitride. However, it has been found to be difficult to control the amount of acid soluble aluminum present in the steel, and this in turn causes magnetic properties to be unpredictable and non-uniform.

U.S. Pat. No. 3,764,406, issued to the present inventor, discloses another solution to the problem of excessive grain growth in strand cast slabs before hot rolling. In the process of this patent the strand cast slabs are initially hot reduced, i.e. pre-rolled, while between the temperature of 750° and 1250° C., with a reduction in thickness of 5% to 50%, before reheating to about 1400° C. prior to conventional hot rolling. However, this method, while effective in obtaining uniformly excellent magnetic properties, requires slab reheat and initial hot rolling facilities which are not standard mill equipment and hence requires substantial additional capital investment.

It is a principal object of the present invention to provide a process for producing oriented silicon iron from strand cast slabs without the presence of aluminum nitride as a grain growth inhibitor and without the initial hot reduction or pre-rolling step of the above mentioned U.S. Pat. No. 3,764,406.

The above objective is achieved in a process which involves observance of relatively narrow composition ranges in the melt and by following a specific sequence of processing steps in which specific operating parameters are observed. While a number of the composition ranges and processing steps are known per se, the combination is believed to provide a cumulative effect which is synergistic and hence unobvious to a person skilled in the art.

From the standpoint of composition, the carbon, titanium, nitrogen, and acid soluble aluminum contents are of particular criticality. More specifically, a carbon range of 0.030% to 0.045% by weight in the melt, a titanium content not greater than 0.003%, a nitrogen content not greater than 0.005%, and virtual absence of acid soluble aluminum appear to be essential for optimum properties in the final product.

Carbon overlapping or embracing the above range is disclosed in the previously mentioned French Pat. No. 70.09122, U.S. Pat. No. 4,006,044, and in U.S. Pat. No. 3,876,476 and Japanese Patent Publication No. 74-024,767.

No disclosure regarding titanium is present in any prior art of which applicant is aware.

Nitrogen contents within the maximum set forth above are disclosed in Japanese Patent Publication No.

74-024,767. U.S. Pat. No. 4,006,044, U.S. Pat. No. 4,039,321 and Belgian Pat. No. 826,152.

A total aluminum content not greater than 0.003% is preferred in the process of the present invention with no aluminum in acid soluble form. Total aluminum contents below this maximum value are included in the aluminum ranges specified in U.S. Pat. Nos. 4,006,044 and 3,876,476. However, both these patents contemplate the use of acid soluble aluminum to form aluminum nitride for control of secondary recrystallization whereas virtually no soluble aluminum is contemplated in this invention.

U.S. Pat. No. 4,006,044 is concerned primarily with avoidance of blister formation in the final product. This problem is alleged to be avoided by restricting aluminum to less than 0.04%, hydrogen to less than 3 parts per million (ppm), or hydrogen to less than 3 ppm together with oxygen less than 80 ppm and nitrogen less than $[Al(\%)\times 10^3+50]$ ppm. Blister occurrence is not avoided when only nitrogen, or only nitrogen and oxygen are restricted within the above limits, according to the patentees. It is necessary that "the contents of hydrogen and nitrogen, or oxygen," be maintained within the above limits in order to prevent blister occurrence. However, in those specific examples where low levels of aluminum are present, the level of oxygen is above the limit contemplated in this invention.

With respect to processing, French Pat. No. 70.9122 discloses the production of oriented silicon iron from strand cast slabs wherein a molten ferrous charge is tapped into a ladle to which is added the amount of silicon required for the desired final grade (within the range of 2.5 to 4.0%), wherein the melt is vacuum degassed to reduce the hydrogen content to less than 1 part per million, the melt further having a carbon content of about 0.027% to about 0.040%, a manganese content of about 0.04% to about 0.08%, a sulfur content of about 0.020% to about 0.026%, an oxygen content of less than about 0.004%, and the balance essentially iron. The melt is then continuously cast with cooling of the slab before complete solidification thereof at the minimum rate necessary to provide sufficient skin strength to support the molten interior of the slab without uncontrolable distortion which can cause voids and blisters. The cast slab is thereafter reduced to final thickness by conventional hot rolling and cold rolling within intermediate annealing.

DETAILED DESCRIPTION

According to the present invention there is provided a process for producing oriented silicon iron from strand cast slabs having uniformly high permeability and low core loss which comprises the steps of melting a ferrous charge, refining said charge to obtain a melt consisting essentially of, in weight percent, 0.030% to 0.045% carbon, about 0.04% to about 0.08% manganese, about 0.015% to about 0.025% sulfur and/or selenium, not more than 0.003% titanium, not more than 0.005 nitrogen, residual oxygen, and balance essentially iron, adding sufficient silicon to provide a range of 2.5% to 4.0% silicon and sufficient aluminum to combine with oxygen in the melt and obtain an oxygen content of not more than 0.005%, casting the melt into a slab thickness of about 125 to 225 mm, cutting into suitable lengths, reheating the slabs within the range of about 1330° to about 1400° C., hot rolling to band thickness, cold rolling to an intermediate thickness, annealing at about 850° to about 950° C., cold rolling to final thickness, decarburizing in a hydrogen-containing atmosphere, applying an annealing separator coating to the surfaces of the cold rolled, decarburized material, and subjecting the material to a final anneal in a hydrogen-containing atmosphere for a period of time sufficient to effect secondary recrystallization.

In the preferred practice of the present invention the melt is prepared by conventional facilities such as an open hearth furnace, electric furnace, or cupola. The use of an argon-oxygen vessel is preferred since low nitrogen contents can be achieved therein. Silicon is added during tapping or pouring into the ladle, and aluminum is added at the same stage for deoxidation. The preferred composition of the refined melt after degassing and stirring (and of the cast slab) is, in weight percent, about 0.032% to about 0.042% carbon, about 0.040% to about 0.070% manganese, about 0.016% to about 0.023% sulfur, about 3.0% to about 3.3% silicon, not more than 0.003% titanium, not more than 0.003% total aluminum, not more than 0.005% nitrogen, not more than 0.005% oxygen, and balance essentially iron. Preferably the amount of acid soluble aluminum is not more than 0.002%. Normally occurring elements such as copper, chromium and nickel may be present in amounts up to 0.2% or even 0.3% each, without adverse effects on magnetic properties.

Electro-magnetic stirring of the casting is beneficial. A more uniform cast slab structure is produced, and is believed to minimize grain growth during slab reheating before hot rolling. Electro-magnetic stirring can be carried out in accordance with the teachings of Belgian Pat. No. 857,596.

Continuous casting may be conducted under the conditions disclosed in the above-mentioned French Pat. No. 70.09122, which includes protecting the metal from oxidation, and cooling the slab (before complete solidification thereof) at the minimum rate necessary to provide sufficient skin strength to support the molten interior of the slab without uncontrollable distortion. Protection of the molten metal stream from the atmosphere is helpful in preventing pickup of nitrogen from the air and is preferably effected by an argon shroud, by a ceramic seal, or both.

Preferably the slab exit temperature, measured at the exit of the spray chamber, is not higher than about 855° C.

The preferred slab thickness is about 150 to about 160 mm.

When reheating the slabs within the range of 1330° to 1400° C., it is preferred to restrict the total reheating time to not more than 200 minutes in order to minimize grain growth.

Hot rolling is preferably accomplished by roughing to a thickness of about 28 to 32 mm, followed by finishing to a thickness of about 2.0 mm, the hot rolling finish temperature preferably being above 900° C.

Preferably the hot rolled band is subjected to an anneal conducted at about 925° to 1050° C. in order to promote recrystallization and optimum distribution of carbon. Although not critical, a furnace soaking time of 30–60 seconds in a slightly oxidizing gas atmosphere is preferred, followed by cooling by radiation to a water-cooled zone, or in air.

The hot rolled and annealed strip is pickled in conventional manner for scale removal, and the first stage of cold rolling is preferably to an intermediate thickness ranging between about 0.5 and 0.9 mm, the intermediate thickness being determined by the desired final thickness and manganese content, this relation being set forth below.

After the first stage of cold rolling the intermediate anneal is preferably conducted at about 925° C. with a soaking time of about 30–60 seconds in a reducing or non-oxidizing atmosphere. Alternatively, a temperature of about 850° C. may be used with a soaking time to about 120 seconds. Partial decarburization may also be effected during this intermediate anneal by introducing a wet hydrogen atmosphere.

At final thickness of about 0.25 to about 0.35 mm the strip is preferably decarburized to a carbon level of not greater than 0.003%. A strip anneal in wet hydrogen at about 820° to 840° C. is preferred for decarburization.

The final anneal is preferably conducted at about 1150° to about 1220° C. for a period of time up to 24 hours, in a dry hydrogen-containing atmosphere which is reducing to oxides of iron, thus effecting secondary recrystallization. Some nitrogen and sulfur (and/or selenium) may be removed during the final anneal.

The above mentioned relation between final thickness, intermediate thickness and manganese content is as follows:

Cold Reduction
Relation of Final Thickness to Intermediate Thickness and Manganese Content

| Final Thickness (mm) | % Mn | Intermediate Thickness (mm) |
|---|---|---|
| 0.346 | 0.045 | 0.82 |
| | 0.08 | 0.68 |
| 0.294 | 0.04 | 0.75 |
| | 0.075 | 0.60 |
| 0.264 | 0.04 | 0.70 |
| | 0.075 | 0.55 |

For each final thickness the minimum manganese and maximum intermediate thickness constitute one coordinate while the maximum manganese and minimum intermediate thickness constitue another coordinate which may be plotted as a slope, with values between the two extremes being obtainable by interpolation.

For optimum results the strand cast slab should be cooled as slowly as possible. Although not critical, it is preferred to cool the slab at substantially the same rate as that disclosed in the above mentioned French Patent 70.09122. In the particular slab casting equipment in which tests have been conducted, a cooling water rate of less than 1.6 liter per kilogram of steel was used with excellent results.

A number of heats have been produced in accordance with the process of the invention, with variations in carbon, titanium and nitrogen contents which establish the criticality of the ranges for each set forth above. Data regarding these heats and the magnetic properties of the final products therefrom are set forth in the examples which follow:

EXAMPLE 1

Two heats designated as A and B were prepared by the same process which comprised melting in an electric furnace, degassing and continuous casting into slabs of 152 mm thickness. The compositions of the two heats as cast were as follows:

| | Heat A | Heat B |
|---|---|---|
| Carbon | 0.032% | 0.032% |
| Manganese | 0.057 | 0.063 |
| Sulfur | 0.024 | 0.023 |
| Silicon | 3.25 | 3.12 |
| Titanium | 0.0027 | 0.0027 |
| Aluminum (total) | 0.0018 | 0.0016 |
| Nitrogen | 0.0045 | 0.0064 |
| Oxygen | 0.0019 | 0.0054 |
| Iron | balance | balance |

The slabs were reheated to 1400° C. and hot rolled to a thickness of 1.5 mm. The hot rolled bands were strip annealed at 985° C. with a soak time of about 40 seconds, pickled and cold rolled to a thickness of 0.74 mm. The strips were then annealed in nitrogen at 925° C. for about 30 seconds, and were cold rolled to a final thickness of 0.346 mm. The strips were then decarburized for 2 minutes at 825° C. in a wet hydrogen atomosphere. A magnesia annealing separator coating of conventional type was applied, and the strips were annealed at 1175° C. in dry hydrogen for about 20 hours.

Average magnetic properties of coils of these heats are set forth in Table I below.

EXAMPLE 2

A heat designated as C was prepared and processed in such manner as to compare the effect of annealing after hot rolling on final magnetic properties.

The charge was melted in an electric furnace, refined in an argon vessel, argon stirred and continuously cast into slabs of 152 mm thickness. The composition of the cast material was as follows:

| | Heat C |
|---|---|
| Carbon | 0.037% |
| Manganese | 0.058 |
| Sulfur | 0.021 |
| Silicon | 3.08 |
| Titanium | 0.0016 |
| Aluminum (total) | 0.0020 |
| Nitrogen | 0.0035 |
| Oxygen | 0.0053 |
| Iron | Balance |

The slabs were reheated to 1350° C. and hot rolled to a thickness of 2.0 mm. Several coils were annealed at 985° C. with a soak of about 30 seconds, and an equal number of coils was not annealed. All coils were then pickled and cold rolled to a thickness of 0.68 mm, annealed in dry nitrogen at 925° C. for about 40 seconds, and cold rolled to a final thickness of 0.30 mm. The coils were then decarburized at 830° C. in wet hydrogen for about 2 minutes. After coating with magnesia annealing separator the coils were box annealed in dry hydrogen at about 1175° C. for about 20 hours. A secondary phosphate coating was then applied and the coils were flattened.

Two additional heats (designated as C1 and C2) having compositions very similar to that of heat C were also prepared by the same processing as heat C with half the coils in each heat being subjected to an anneal at 985° C. after hot rolling and the remaining coils not being annealed. A comparison of the magnetic properties of these heats is set forth in Table I. It will be noted that in all instances significantly better magnetic properties were obtained with an initial anneal after hot rolling to a thickness of about 2.0 mm.

EXAMPLE 3

Two heats designated as D and E demonstrate the effect on magnetic properties of titanium contents below and above 0.003%. Heats D and E were processed in the same manner as heat C, except that all coils were subjected to an anneal after hot rolling at 985° C. with a soak of about 30 seconds. The compositions of heats D and E after casting were as follows:

| | Heat D | Heat E |
|---|---|---|
| Carbon | 0.038% | 0.038% |
| Manganese | 0.063 | 0.058 |
| Sulfur | 0.020 | 0.021 |
| Silicon | 3.16 | 3.17 |
| Titanium | 0.0025 | 0.0041 |
| Aluminum (total) | 0.0020 | 0.0020 |
| Nitrogen | 0.0028 | 0.0028 |
| Oxygen | 0.0051 | 0.0041 |
| Iron | balance | balance |

The magnetic properties of heats D and E are summarized in Table I, and it will be noted that heat D (containing 0.0025% titanium) exhibited a significant superiority over heat E (containing 0.0041% titanium). The differences in manganese and oxygen contents of these two heats are not believed to be of great enough significance to affect the magnetic properties.

EXAMPLE 4

A heat designated as F demonstrates the effect of a carbon content below the minimum of 0.03% of the present invention and may be compared with heat A. Heat F was processed in the same manner as heats A and B to a final thickness of 0.346 mm, the composition of the cast material being as follows:

| | Heat F |
|---|---|
| Carbon | 0.029% |
| Manganese | 0.069 |
| Sulfur | 0.024 |
| Silicon | 3.11 |
| Titanium | 0.0031 |
| Aluminum (total) | 0.0015 |
| Nitrogen | 0.0053 |
| Oxygen | 0.0034 |
| Iron | balance |

Magnetic properties of heat F are set forth in Table I, and a comparison thereof with those of heat A, (having a carbon content of 0.032%) demonstrates the importance of a minimum carbon content of 0.030%.

With respect to the criticality of the nitrogen content, a comparison of heats A and B is believed to demonstrate that nitrogen in excess of 0.005% adversely affects both core loss and permeability values.

EXAMPLE 5

A heat designated as G was prepared and processed to a final thickness of 0.27 mm for comparison with heats A and B having a final thickness of 0.346 mm. Heat G was melted in an electric furnace and refined in an argon vessel. The melt was poured into a ladle and adjusted, while stirring with argon, to the following composition:

| | Heat G |
|---|---|
| Carbon | 0.035% |
| Manganese | 0.055 |
| Sulfur | 0.018 |
| Silicon | 3.18 |
| Titanium | 0.0019 |
| Aluminum (total) | 0.0030 |
| Nitrogen | 0.0034 |
| Oxygen | 0.0058 |
| Iron | balance |

The heat was strand cast into slabs of 152 mm thickness, which were reheated to 1370° C. and hot rolled to a thickness of 2.0 mm. The total reheating time was less than 190 minutes. The hot rolled coils were annealed at 985° C. with a soak of about 30 seconds, pickled, and cold rolled to an intermediate thickness of 0.63 mm. The coils were then subjected to an intermediate anneal at 925° C. in dry nitrogen for about 40 seconds, and were then cold rolled to a final thickness of 0.27 mm. The coils were then decarburized at 830° C., coated with a magnesia annealing separator and box annealed in dry hydrogen at about 1175° C. for a total time of about 20 hours. The magnetic properties of heat G are set forth in Table I, from which it will be evident that this thinner material, having a preferred composition, and prepared in accordance with the process of the present invention, exhibited significantly better magnetic properties than the thicker material of heats A and B.

In all the above Examples copper, chromium and nickel ranged from less than about 0.1% each to a maximum of about 0.16% nickel in one Example, the average being about 0.1% each.

TABLE I

| Heat | Thickness (mm) | Core Loss w/kg Pl.5;60 | Pl.7;60 | Permeability B = 800 A/m |
|---|---|---|---|---|
| A | 0.346 | 1.32 | | 1831 |
| B | 0.346 | 1.36 | | 1810 |
| C (annealed) | 0.30 | 1.13 | 1.65 | 1826 |
| C (no anneal) | 0.30 | 1.16 | 1.70 | 1817 |
| C1 (annealed) | 0.30 | 1.135 | 1.663 | 1821 |
| C1 (no anneal) | 0.30 | 1.148 | 1.676 | 1818 |
| C2 (annealed) | 0.27 | 1.088 | | 1823 |
| C2 (no anneal) | 0.27 | 1.119 | | 1819 |
| D | 0.30 | 1.13 | | 1832 |
| E | 0.30 | 1.18 | | 1822 |
| F | 0.346 | 1.405 | | 1796 |
| G | 0.27 | 1.065 | 1.555 | 1837 |

What is claimed is:

1. A process for producing grain oriented silicon iron from strand cast slabs having uniformly high permeability and low core loss, which comprises the steps of melting a ferrous charge, refining said charge to obtain a melt consisting essentially of, in weight percent, 0.030% to 0.045% carbon, about 0.04% to about 0.08% manganese, about 0.015% to about 0.025% sulfur and/or selenium, not more than 0.003% titanium, not more than 0.005% nitrogen, residual oxygen, and balance essentially iron, adding sufficient silicon to provide a range of 2.5% to 4.0% silicon and sufficient aluminum to combine with oxygen in the melt and obtain an oxygen content of not more than 0.005%, casting the melt into a slab thickness of about 125 to about 225 mm, cutting into suitable lenghts, reheating the slabs within the range of about 1330° to about 1400° C., hot rolling to band thickness, cold rolling to an intermediate thickness, annealing at about 850° to about 950° C., cold rolling to final thickness, decarburizing in a hydrogen-containing atmosphere, applying an annealing separator coating to the surfaces of the cold rolled, decarburized material, and subjecting the material to a final anneal in a hydrogen-containing atmosphere for a period of time sufficient to effect secondary recrystallization.

2. The process claimed in claim 1, wherein said slab consists essentially of, in weight percent, about 0.032% to about 0.042% carbon, about 0.040% to about 0.070% manganese, about 0.016% to about 0.023% sulfur, about 3.0% to about 3.3% silicon, not more than 0.003% titanium, not more than 0.003% total aluminum, not more than 0.005% nitrogen, not more than 0.005% oxygen, and balance essentially iron.

3. The process claimed in claim 1 or 2, including the step of protecting said melt from the atmosphere during the casting step.

4. The process claimed in claim 1, wherein the hot rolled band is annealed at about 925° to 1050° C.

5. The process claimed in claim 1 or 2 wherein said ferrous charge is melted in an electric furnace, and subjected to at least one of argon stirring and vacuum degassing.

6. The process claimed in claim 1 or 2, wherein said melt is cast into a slab thickness of about 150 to about 160 mm, wherein the slab reheating time does not exceed 200 minutes and wherein the hot rolled band is annealed in a non-oxidizing atmosphere with a soaking time of 30 to 60 seconds.

7. The process claimed in claim 1 or 2, wherein the hot rolled band is cold rolled to an intermediate thickness ranging between about 0.5 and 0.9 mm determined by the desired final thickness and manganese content, wherein the cold rolled material is subjected to an intermediate anneal at about 925° C. with a soaking time of about 30 to 60 seconds in a non-oxidizing atmosphere, and wherein the material is cold rolled to a final thickness of about 0.25 to about 0.35 mm and decarburized to a carbon level not greater than 0.003% in a wet hydrogen atmosphere.

8. The process claimed in claim 7 wherein said cold rolled material is partially decarburized during said intermediate anneal in a wet hydrogen atmosphere.

9. The process claimed in claim 1 or 2, wherein the cold rolled material is subjected to an intermediate anneal at a temperature of about 850° C. with a soaking time of about 120 seconds in an inert atmosphere.

10. The process claimed in claim 1 or 2, wherein the final thickness of the cold rolled, decarburized material is not greater than 0.30 mm.

11. The process claimed in claim 1 or 2, wherein said cold rolled, decarburized material is subjected to a final anneal in dry hydrogen for at least 10 hours at 1150° to 1220° C.

12. The process claimed in claim 1 or 2, wherein electro-magnetic stirring is used during the casting step.

13. The process claimed in claim 2, wherein said slab contains not more than 0.002% acid soluble aluminum.

14. The process claimed in claim 1, wherein said slab contains not more than 0.003% total aluminum.

* * * * *

UNITED STATES PATENT AND TRADEMARK OFFICE

CERTIFICATE OF CORRECTION

PATENT NO. : 4,202,711

DATED : May 13, 1980

INVENTOR(S) : Martin F. Littmann and Allan R. Obman

It is certified that error appears in the above-identified patent and that said Letters Patent are hereby corrected as shown below:

Title page, item [73], "Armco, Incl."
should read --Armco Inc.--

Column 3, line 44, "controlable" should read
--controllable--.

Column 4, line 1, "hydrogen-contain g" should read
--hydrogen-containing--.

Signed and Sealed this

*Fifth* Day of *August 1980*

[SEAL]

*Attest:*

SIDNEY A. DIAMOND

*Attesting Officer*

*Commissioner of Patents and Trademarks*